United States Patent [19]

Cantrell

[11] 4,185,433

[45] Jan. 29, 1980

[54] BAFFLE BOARD CONSTRUCTION

[75] Inventor: James E. Cantrell, Greenville, S.C.

[73] Assignee: Thermal Insulation Company, Greenville, S.C.

[21] Appl. No.: 908,503

[22] Filed: May 22, 1978

[51] Int. Cl.[2] ..... E04B 2/00; E04B 1/74

[52] U.S. Cl. ..... 52/404; 52/94

[58] Field of Search ..... 98/32, 37, 42, DIG. 6; 52/94, 95, 406, 407, 92, 404

[56] References Cited

U.S. PATENT DOCUMENTS

| | | | |
|---|---|---|---|
| 1,894,592 | 1/1933 | Kilmer | 52/407 |
| 3,035,374 | 5/1962 | Allen | 52/289 |
| 3,160,987 | 12/1964 | Pinkley | 98/DIG. 6 |
| 3,683,785 | 8/1972 | Grange | 48/37 |
| 4,069,628 | 1/1978 | Kreimer | 98/32 |
| 4,125,982 | 11/1978 | Ward | 52/404 |

*Primary Examiner*—John E. Murtagh

*Attorney, Agent, or Firm*—Finnegan, Henderson, Farabow, Garrett & Dunner

[57] ABSTRACT

A baffle board for use in house construction to prevent loss of blown-in insulation through the eaves and yet to provide clearance ventilation space between the baffle board and the sheathing. The baffle board is a standard construction adapted for use in truss roofs and offset roofs, and with framing members of different standard widths. A generally rectangular piece of stiff material having plurality of both longitudinal and transverse score lines and slits for folding forms a baffle board which is quickly shapable for use in most standard roof constructions.

12 Claims, 13 Drawing Figures

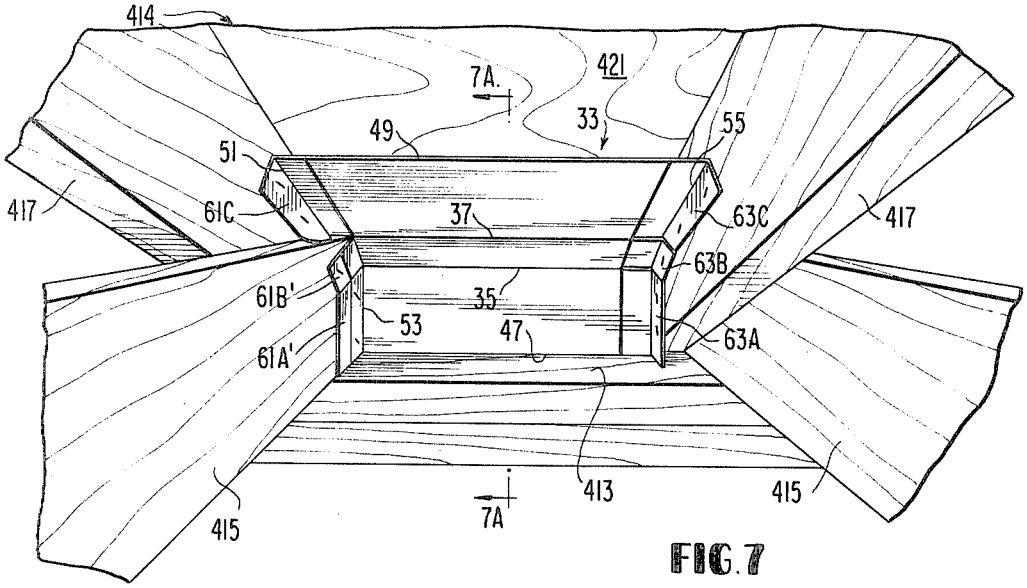
FIG. 7
FIG. 7A
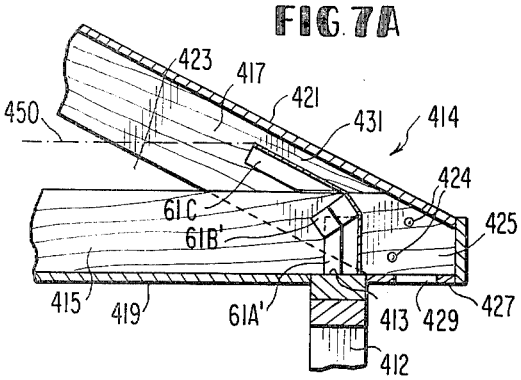
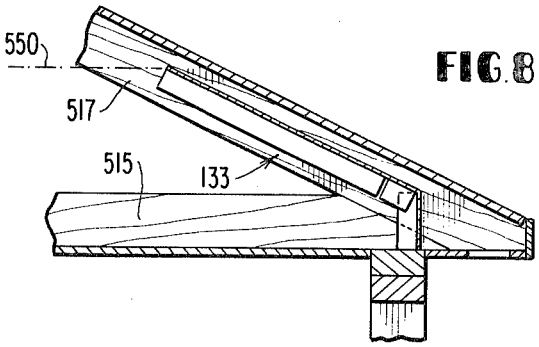
FIG. 8
FIG. 3
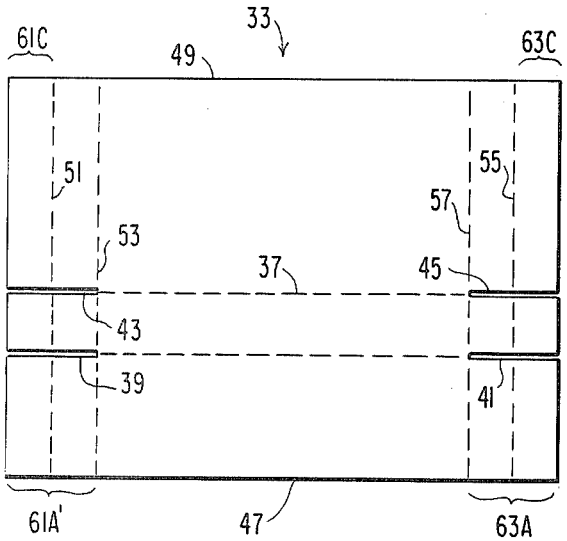
FIG. 9
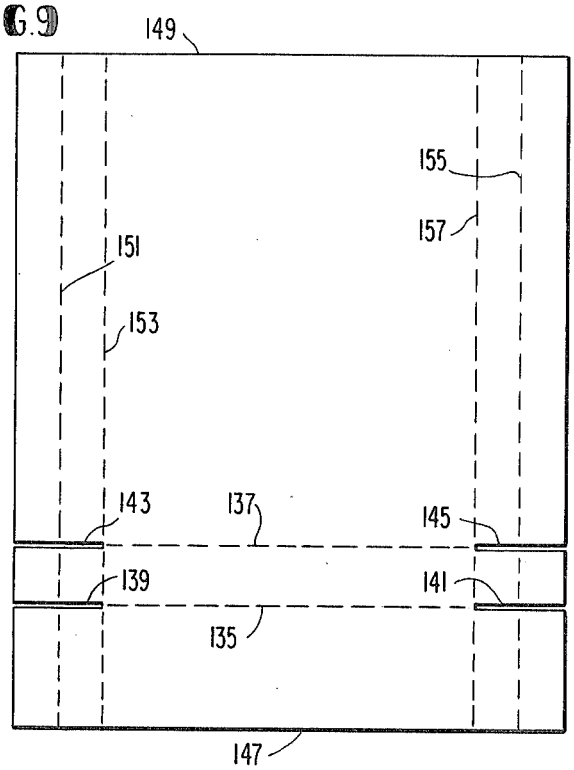

BAFFLE BOARD CONSTRUCTION

BACKGROUND OF THE INVENTION

The present invention relates to a baffle board construction which, pursuant to insulating the attic space of buildings, partially blocks the openings which connect the attic space and the overhanging eaves. More particularly, this invention relates to a baffle board construction of the type described which provides that insulation blown into the attic will extend to the outermost perimeter of the walls and will not be lost into the eaves; which insures that proper ventilation is maintained between the attic space and the eaves after insulation; and which is a standard unit facilitating use with different type roofs, including truss and offset roof constructions, and roofs using framing members of different widths.

In many building constructions, the roofs are made using framing members which include horizontal ceiling joists and inclined roof rafters which are connected in the area of a top plate forming the top surface of the building walls. The roof rafters extend outwardly beyond the building walls and form hollow eaves. Openings between the roof framing members and openings in the underside of the eaves ventilate the attic space of the building to the atmosphere so that heated air can escape from the attic.

It has become customary to insulate the attic space of these buildings with a particulate insulation material which is blown in place. In that case, it is necessary to install baffle boards in the openings between the roof framing members to form a dam to prevent insulation which is blown in place from being lost into the eaves. These baffle boards, which may be constructed of cardboard or the like, are positioned in the openings and may be secured to the roof framing members and/or the wall top plate such as by stapling.

It is important that insulation in the attic space of buildings extend as close to the outermost periphery of the building walls as possible to minimize heat loss at the perimeter of the building. Thus, it is important that the baffle boards be positioned to allow the insulation which is blown in place to extend as close to the outside perimeter of the walls as possible.

It is also important that adequate ventilation be maintained between the attic space and the eaves after insulation for proper air circulation between the eaves and the attic space. This is necessary in order to prevent heated air from being trapped in the attic space which would cause the rooms beneath the ceiling to remain excessively warm during warm weather, and to prevent moisture buildup in the attic space during the winter. Thus, it is important that the baffle boards used do not themselves completely block the openings between the attic space and the eaves, or allow the insulation to completely block these openings.

Still further, there are a number of "standard" building roof designs, including truss and offset roofs. In a truss roof, the roof rafters and ceiling joists are aligned (coplanar) and joined at abutting edges using suitable connector plates. In an offset or "stick built" roof, the ceiling joists are fastened to one side of adjacent roof rafters. Furthermore, offset roofs sometimes have ceiling joists fastened to both sides of each roof rafter such as in the area of load bearing walls, referred to as a double offset roof. In addition, all of these "standard" roofs can be constructed using different sized framing members.

It will be appreciated, therefore, that the size and shape of the openings in which the baffle boards are to be positioned are different for each of the identified "standard" roof constructions, and for each of those constructions which use different sized framing members. If a different baffle board is required for each of the different roofs, it is then necessary for the baffle board manufacturer to make, and for the installer to stock, a wide variety of different baffle boards. In addition to the obvious inconvenience, this results in higher manufacturing and inventory costs, and ultimately higher prices to the consumer.

SUMMARY OF THE INVENTION

The present invention overcomes the above problems and disadvantages in a manner not comtemplated by the prior art. The present invention fulfills all the fundamental requirements of a baffle board by providing a construction which is capable of partially blocking the openings between roof framing members so that insulation blown in place in the attic will not be lost into the eaves; by providing a construction which allows the insulation blown in place to extend as close to the outermost periphery of the building walls as possible thereby maximizing the effect of that insulation; and by providing a construction which insures that proper ventilation between the attic space and the eaves is maintained for escape of heated air and moisture from the attic space. Importantly, the baffle board of the present invention goes further in that it provides a standard unit designed for use with truss roofs as well as offset roof constructions, and with a variety of sizes of roof framing members used in those standard roofs. Thus, the baffle board manufacturer is required to make and the installer is required to stock a minimum of different varieties of baffle boards. This standardization of baffle board design facilitates lower manufacturing and inventory costs, and correspondingly lowers the price to the consumer.

Additional objects and advantages of the invention will be set forth in part in the description which follows, and in part will be obvious from the description, or may be learned by practice of the invention. The objects and advantages of the invention may be obtained by means of the instrumentalities and combinations particularly pointed out in the appended claims.

To achieve the objects and in accordance with the purpose of the invention, as embodied and broadly described herein, the insulation baffle board of this invention is constructed for use in buildings of the type having upstanding walls provided with a horizontal top plate, and a roof provided with framing members which include horizontal ceiling joists and rafters inclined upwardly from the ceiling joists, ceiling means fixed to the ceiling joists and roof sheathing fixed atop the roof rafters, the ceiling means and roof sheathing defining an attic space, the ceiling joists and roof rafters coming together and secured in the area of the top plate, and the roof rafters extending outwardly beyond the top plate forming eaves, the attic space and eaves being communicated by openings defined between adjacent pairs of roof framing members, the baffle board comprising a generally rectangularly shaped piece of stiff material, the baffle board having a pair of longitudinal fold lines along one side and a pair of longitudinal fold lines along the other side thereof, the longitudinal fold lines extending the full length of the baffle board, at least one transverse fold line extending between the innermost ones of the longitudinal fold lines, and slits extending from the ends of the at least one transverse fold line to opposite side edges of the baffle board, the baffle board being foldable along the at least one transverse fold line and positionable in the openings communicating the attic space and eaves so that a first section from one end to the at least one transverse fold line extends generally vertically of the top plate, and a second section from the at least one transverse fold line to the other end extends generally along and spaced from the roof sheathing, the baffle board being foldable along the longitudinal fold lines at each side edge to form tab means which lie against the roof framing members and can be secured thereto, the longitudinal fold lines facilitating selective folding of the baffle board to selectively form first and second sections of different widths.

Broadly, the baffle board of this invention comprises a generally rectangular sheet of stiff material, first and second longitudinal fold lines extending the full length of the board along both sides thereof, the first longitudinal fold lines being spaced apart a distance substantially equal to a standard distance between adjacent ceiling joists and between adjacent roof rafters, the second longitudinal fold lines being spaced inwardly of adjacent ones of the first longitudinal fold lines a distance substantially equal to the standard thickness of roof framing members, at least one transverse fold line extending across the board between the second longitudinal fold lines, and slits extending from opposite ends of the at least one transverse fold line to the side edges of the board, whereby the board can be selectively folded along the longitudinal fold lines to form first and second sections of different widths.

The accompanying drawings which are incorporated in and constitute part of this specification illustrate embodiments of the invention and, together with the description serve to explain the principles of the invention.

BRIEF DESCRIPTION OF THE DRAWINGS

FIG. 3 is a plan view showing the preferred form of baffle board before folding.

FIG. 7 is a view similar to FIG. 1 showing the preferred form of baffle board folded and installed in a stick built or offset roof using roof framing members of the same size as is shown in FIG. 4;

FIG. 7A is a sectional view of FIG. 7 taken along the line 7A—7A thereof;

FIG. 8 is a view similar to FIG. 2 and showing a modified form of the invention;

FIG. 9 is a view similar to FIG. 3 showing the modified form of baffle board illustrated in FIG. 8.

DESCRIPTION OF THE PREFERRED EMBODIMENTS

Figure 1:
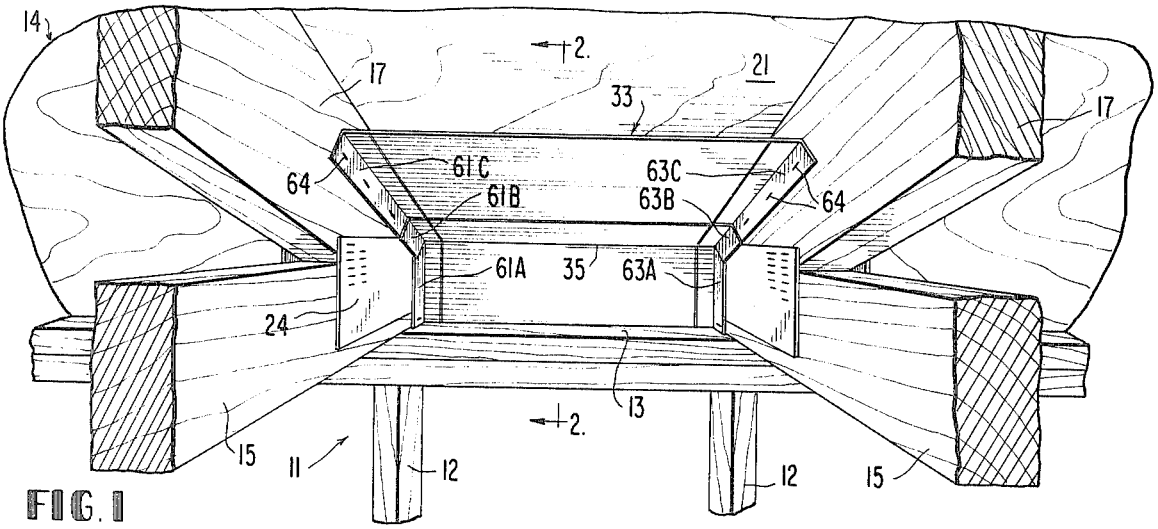
FIG. 1 is a perspective view illustrating a preferred form of baffle board constructed according to the invention and shown mounted in place in a standard truss roof.
Figure 2:
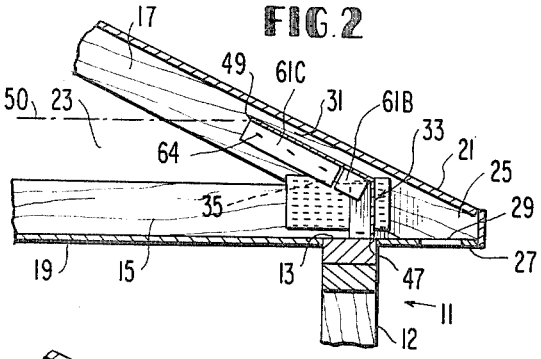
FIG. 2 is a sectional view of the structure of FIG. 1 taken along the line 2—2 thereof and shown to a reduced scale.

With reference to FIGS. 1 and 2, the present invention is intended for use in the buildings of the type having upstanding walls, one shown at 11, which includes vertical studs 12 connected by a horizontal top plate 13. A roof 14 for the building is made up of roof framing members which include horizontal ceiling joists 15 and roof rafters 27 which incline upwardly from the ceiling joists. Ceiling means, e.g. wall board 19, is fixed to the underside of the joists 15, while roof sheathing 21 is fixed to the top side of rafters 17. The wall board 19 and roof sheathing 21 define an attic space 23 for the building.

The ceiling joists 15 and roof rafters 17 come together and are secured in the area of the wall top plate 13. In the case of the roof shown here which is a truss roof, the framing members are secured together by connector plates 24.

The roof rafters 17 extend beyond the wall top plate 13 and form eaves, one shown at 25. As is conventional, the eave 25 is hollow and is covered along the bottom by sheathing 27 which is provided with ventilation openings 29.

The attic space 23 and the hollow eaves 27 are communicated by openings defined between the roof framing members, and specifically between adjacent pairs of ceiling joists 15 and roof rafters 17, the wall top plate 13 and the roof sheathing 21. One such opening is illustrated at 31 in FIGS. 1 and 2 and shown partially obstructed by a baffle board 33 embodying the present invention. The purpose of the openings 31 is to allow heated air and moisture in the attic space 23 to escape through the ventilation openings 29 in the eaves 25.

In accordance with the invention, the baffle board 33, shown in plan in FIG. 3, is a generally rectangular sheet of stiff material and is provided with transverse fold means spaced from its ends. As here embodied, the baffle board 33 can be made of paperboard or similar material, and the transverse fold means includes first and second fold lines 35, 37 which are formed by scoring or pinching the paperboard and which extend part way across the board 33. The board 33 is slitted or cut at 39, 41 from the ends of fold line 35 to opposite side edges of the board. Similarly, the board is cut or slitted at 43, 45 from the ends of fold line 37 to opposite side edges of the board.

In accordance with the invention, the baffle board 33 is foldable along the transverse fold means to form a first section which extends from one end of the board to the transverse fold means, and a second section which extends from the transverse fold means to the other end of the board. As here embodied, when the baffle board 33 is folded along fold line 35, the first section extends from an end 47 (or end 49) to fold line 35, and the second section extends from fold line 35 to an opposite end 49 (or end 47). When the baffle board 33 is folded along fold line 37, the first section extends from end 47 (or end 49) to fold line 37, and the second part extends from fold line 37 to end 49 (or end 47).

In accordance with the invention, the baffle board 33 is folded along the transverse fold means so that when positioned in one of the openings 31, the first section extends generally vertically from as close to the outer edge of top plate 13 as possible, and the second section extends generally along and spaced from the roof sheathing 21. As here embodied, the roof rafters 17 of the illustrated truss roof incline upwardly from a position at or near the outer edge of the top plate 13. Therefore, the vertical dimension from the outer edge of the top plate 13 to the roof sheathing 21 is slightly greater than the width of the ceiling joists 15. Accordingly, the length of the first baffle board section is preferably substantially equal to the width of the ceiling joists 15. The remainder of the length of board 33 constitutes the second section and extends generally parallel to and is spaced from the roof sheathing 21.

With this construction, specifically the vertical disposition of the baffle board first section from as close to the outer edge of the top plate 13 as possible, the insulation which is blown in place in the attic space 23 achieves a maximum allowable thickness over the entire ceiling and extends out to or near the outer edge of the wall top plate 13. The inclined second part of the baffle board 33 and its disposition generally along and spaced from the roof sheathing 21 insures that the openings 31 are not completely blocked and that sufficient ventilation is maintained between the attic space 23 and the eaves 25 to allow heated air and moisture to escape from the attic.

In the illustrated embodiment of FIGS. 1 and 2, the ceiling joists 15 and roof rafters 17 are standard 2×4's and have a width dimension of about 3½". This is the smallest dimensioned roof framing member generally used. It has been found that the length of the first section of baffle board 33 in this installation should be about 3" to about 4". Since this is the smallest length required for the baffle board first section, it is the dimension from end 47 to fold line 35. This achieves a maximum depth of insulation (e.g. 3" to 4") at or near the outer extremity of the building walls. The overall depth of insulation blown in place can extend to the end 49 of the baffle board 33 as indicated by dot-dash line 50 in FIG. 2. This represents a depth of about 8". As illustrated, the second section of baffle board 33 maintains a clearance space of about 1" between the baffle board second section and the roof sheathing 21 for venting the attic space 23.

In accordance with the invention, the transverse fold means facilitates selective folding of the baffle board 33 to different lengths of baffle board first sections. As here embodied and shown in FIG. 4, a roof 114 similar to that shown in FIGS. 1 and 2 is illustrated but which uses roof framing members 115 and 117 which are standard 2×6's having a width dimension of about 5½", of approximately 2" wider than the roof framing members 15, 17 in FIGS. 1 and 2. In all other respects, the roof 114 is the same as roof 14, and similar members with the prefix "1" in FIG. 4 illustrate parts similar to those shown in FIGS. 1 and 2.

Figure 4:
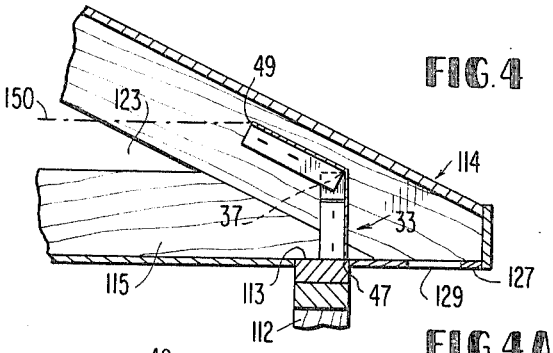
FIG. 4 is a view similar to FIG. 2 and showing the baffle board folded and installed in a truss roof using roof framing members of a width different than FIGS. 1 and 2.
Figure 4A:
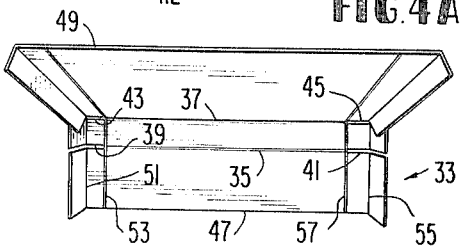
FIG. 4A is a perspective view showing the manner of folding the baffle board for installing in the roof of FIG. 4.

In using the baffle board 33 with the roof of FIG. 4, the board is folded along fold line 37 which is spaced about 2" from fold line 35. The baffle board first section formed then is about 5" to about 6" in length which is the dimension from board end 47 to fold line 37. The baffle board 33 folded along fold line 37 is shown in FIG. 4A, and is shown installed in roof 114 in FIG. 3. In this installation, the blown in insulation can achieve a maximum depth of about 5" to about 6" at or near the outer extremities of the building walls, and an overall depth of about 8" as represented by dot-dash line 150. Again, a clearance of about 1" is maintained between the roof sheathing 121 and the baffle board second section so that heated air and moisture can escape from attic space 123.

In accordance with the invention, the novel baffle board 33 is designed to accommodate use with roof using roof framing members other than 2×4's and 2×6's such as, for example, 2×8's or 2×10's, and with roofs which are set higher off the wall top plate. As here embodied, the baffle board 33 can be reversed, end for end, and positioned so that the end 49 abuts the wall top plate at or near its outer edge. In that case, the baffle board first section is measured from the end 49 to the transverse fold line about which the board is folded. By making the baffle board 33 such that the dimension from end 49 to fold line 37 is about 7" to about 8", the baffle board can be folded, as shown in FIG. 5A, and positioned in ventilation openings 231 formed in roof 214, as shown in FIG. 5.

The insulation blown in place in attic space 223 will achieve a thickness of about 7" to about 8" at or near the outer extremity of the building walls 211 and can achieve an overall thickness of about 9" as indicated by dot-dash line 250.

Figure 5:
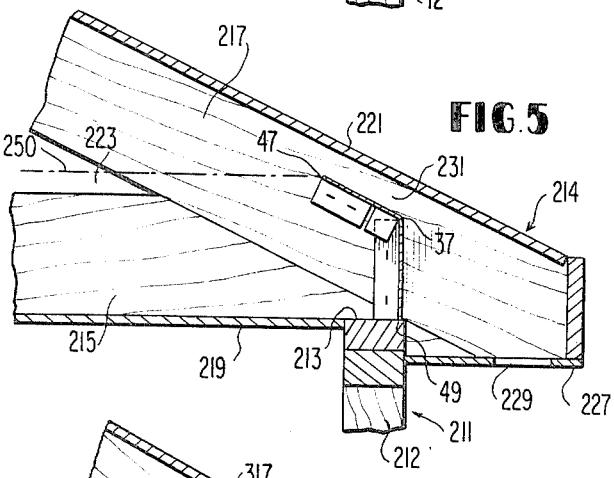
FIG. 5 is a view similar to FIGS. 2 and 4 and showing the baffle board folded and installed in a truss roof using roof framing members of yet another width.
Figure 5A:
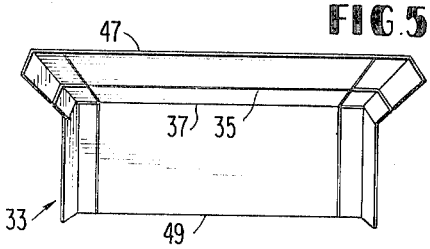
FIG. 5A is a perspective view showing the manner of folding the baffle board for installing in the roof of FIG. 5.

The roof of FIG. 5 is similar to the roofs shown in FIGS. 1 and 2 and in FIG. 4 except that the ceiling joists 215 and roof rafters 217 are standard 2×8's having a width dimension of about 7½". In all other respects, the roof 214 is the same as roof 14 and similar numbers with the prefix "2" in FIG. 5 illustrate parts similar to those in FIGS. 1 and 2.

Figure 6:
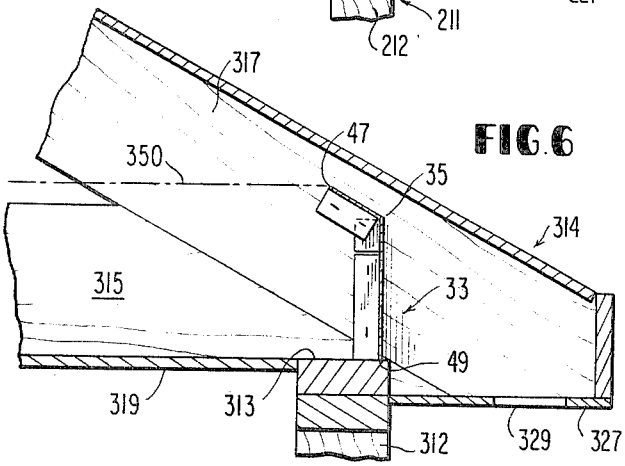
FIG. 6 is a view similar to FIGS. 2, 4 and 5 and showing the baffle board folded and installed in a truss roof using roof framing members of yet another width.
Figure 6A:
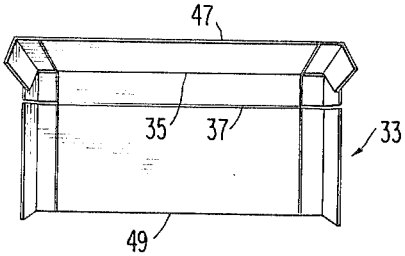
FIG. 6A is a perspective view showing the manner of folding the baffle board for installing in the roof of FIG. 6.

Further, since the dimension from baffle board end 49 to fold line 37 is about 7" to about 8", the dimension from end 49 to fold line 35 is about 9" to about 10". Therefore, baffle board 33 can be folded as shown in FIG. 6A and installed in a roof 314 which uses 2×10's for framing members 315, 317, as shown in FIG. 6.

Still further, it will be appreciated that the baffle board 33 of the present invention readily accommodates roof installations where the roof is set higher or "jacked up" from the wall top plate. In that case, if, for example, a roof using 2×4 framing members is set 4" higher than the wall top plate, the baffle board 33 is folded and installed as shown in FIGS. 5 and 5A.

In accordance with the invention, the baffle board 33 has longitudinal fold means spaced inwardly from each side. As embodied herein, the longitudinal fold means includes a pair of fold lines 51, 53 along one side and a pair of fold lines 55, 57 along the other side of the board 33. All of the longitudinal fold lines 51, 53, 55, 57 extend the full length of the board, and fold line 53 intersects transverse fold lines 35, 37 at their juncture with slits 39, 43, while fold line 57 intersects transverse fold lines 35, 37 at their juncture with slits 41, 45. Longitudinal fold lines 51, 55 intersect slits 39, 43 and 41, 45 respectively.

In accordance with the invention, the baffle board 33 is foldable along the longitudinal fold means at each side edge to form tab means which, when the baffle board is installed in place, lie against the roof framing members and can be secured thereto. As embodied herein and shown in FIGS. 1 and 2, the baffle board 33 is foldable along line 51 to form tab means 61 made up of tabs 61A, 61B, 61C separated by slits 39, 43. Baffle board 33 is also foldable along line 55 to form tab means 63 made up of tabs 63A, 63B, 63C. The individual tabs 61A–C and 63A–C accommodate folding of the baffle board 33 along both the longitudinal and the transverse fold means as is evident from the drawings.

Thus, slits 39, 41 allow the baffle board 33 to be folded along transverse fold line 35 and along longitudinal fold lines 51, 55 and tabs 61A and 61B, and tabs 63A, 63B overlap as shown in FIGS. 1 and 2. The tabs 61A–C and 63A–C lie against the roof framing members 15, 17 as shown in FIGS. 1 and 2 and can be secured thereto such as by stapling at 64.

In accordance with the invention, the longitudinal fold means facilitate selective folding of the baffle board to selectively form first and second baffle board sections of the same of different widths. As embodied herein, the baffle board 33 is folded entirely along longitudinal fold lines 51, 55 for the truss roof illustrated in FIGS. 1 and 2 and described above. In that case, both the first section and the second section of the folded baffle board 33 have the same width.

In addition, the baffle board 33 can be folded along longitudinal fold line 51 for part of its length, and the remainder along line 53, and/or can be folded along line 55 for part of its length and the remainder along line 57. In these cases, the first and second baffle board sections will have different widths.

As embodied herein, longitudinal fold lines 51, 55 are spaced apart a distance substantially equal to a standard spacing between roof framing members, e.g. approximately 15¼" where adjacent roof framing members are approximately 16" on center. In the truss roof construction illustrated in FIGS. 1 and 2, the connected sets of ceiling joists 15 and roof rafters 17 are coplanar and the distance between adjacent sets of roof framing members is the uniform standard dimension, e.g. 15¼". Therefore, each baffle board 33 is folded along longitudinal fold lines 51, 55 for use in this roof.

The roofs of FIGS. 4–6 use roof framing members of different width than the roof of FIGS. 1 and 2. Nevertheless, all the roofs of FIGS. 4–6 are truss roofs so that the spacing between connected sets of roof framing members are the same, e.g. 15¼". Thus, the baffle board 33 is folded along longitudinal fold lines 51, 55 for installation in all the roofs of FIGS. 1, 2 and 4–6.

FIGS. 7 and 7A illustrate a standard roof construction 414 which is not a truss roof. In this construction, generally referred to as an offset or "stick built" roof, the connected sets of roof rafters and ceiling joists are formed by attaching each roof rafter 417 to one side of an adjacent ceiling joist 415 such as by nails 424. Like the embodiment of FIG. 4, the roof framing members shown in FIGS. 7 and 7A are 2×6's, and have a width dimension of about 5½" and a thickness of about 1½".

The roof of FIGS. 7 and 7A includes an attic space 423 formed between roof sheathing 421 secured to the top surface of the roof rafters 417 and wall board 419 secured to the bottom of the ceiling joists 415. The roof rafters 417 extend outwardly beyond wall 411 and form a hollow eave 425. Sheathing 427 closes the bottom of the eave 425 and is formed with ventilation openings 429.

As was described above for the truss roofs of FIG. 4, openings 43 are formed between each connected set of roof framing members and between the roof sheathing 421 and wall top plate 413 to communicate the attic space 423 with the hollow eave 425. However, because each of the ceiling joists 415 are fastened to one side of an adjacent roof rafter 417, as shown in FIG. 6, the size and shape of the openings 431 are somewhat different from the size and shape of the openings 131 in FIG. 4. For the baffle boards 33 to properly fit into openings 431, corresponding alterations in the size and shape of the board must be made.

Referring to FIG. 7, it is seen that the major difference between the opening 431 illustrated there and the opening 131 in FIG. 4 is that the lateral dimension of opening 431 is reduced by the thickness of one ceiling joist 415 at one side of the opening 431. It is noted that the ceiling joist 415 at the other side of opening 431 is on the remote side of the roof rafter 417 to which it is attached, and that roof rafter 417 inclines downwardly to join the wall top plate 413.

The novel baffle board of this invention readily accommodates this roof construction. Since the longitudinal fold line 53 is spaced inwardly from fold line 51 a distance substantially equal to the standard thickness of roof framing members, the baffle board 33 is folded along the longitudinal fold line 53 from its end 47 to slit 43, and along fold line 51 from slit 43 to end 49. The baffle board 33 is also folded along longitudinal fold line 55 and along transverse fold line 37. This forms tabs 63A–C and tab 61C which are stapled in place to the roof rafters 417 in the same manner as was done in FIG. 5. The fold along fold line 53 forms tabs 61A" and 61B' which are stapled to ceiling joist 415.

It will be appreciated that a building constructed with an offset roof as shown in FIGS. 6 and 6A will have openings between adjacent roof framing members, at the opposite side of the building which are the reverse of the openings 431. Looking from the attic space 423 toward these opposite openings, it will be understood that the ceiling joist 415 at the right side of the opening 431 will be set inside the adjacent roof rafter 417. The baffle board 33 of the present invention readily accommodates this construction by folding the board along the longitudinal fold line 57 from the end 47 to the slit 45, and folding along the line 55 from the slit 45 to the end 49. The other side of the baffle board 33 is folded entirely along the longitudinal fold line 51. The fold tabs are stapled in place to the roof rafters 417, 417 and to the one inside ceiling joist 415.

It will also be appreciated that some offset roofs may be constructed with roof rafters which are notched to receive the wall top plate. This lowers the entire roof, and particularly, lowers the roof sheathing with respect to the wall top plate. In that case, it may be necessary, for example, when the roof framing members are 2×6's, to fold the baffle board 33 along transverse fold line 35 instead of fold line 37, as described above for FIGS. 7 and 7A.

In accordance with the invention, the baffle board 33 accommodates use in virtually all offset roof constructions regardless of the width of the roof framing members employed. Thus, the baffle board 33 is folded and positioned in place in exactly the same manner as was described above for the various truss roof constructions, except that the appropriate longitudinal fold line means are selected to accomodate the inside ceiling joist.

In accordance with the invention, the baffle board 33 is also adapted for use in offset roofs using ceiling joists attached at both sides of a roof rafter. This construction, sometimes referred to as a double offset roof, is employed, for example at load bearing walls. There, the width of the openings communicating the attic space with the eaves is reduced by twice the thickness of a standard roof framing member. Baffle board 33 is therefore folded along longitudinal fold lines 53 and 57, and along the appropriate transverse fold line 35, 37 according to the width of the ceiling joist, and is stapled in place to the inner faces of the roof framing member.

As described above, the baffle board 33 accommodates use in a wide variety of standard roof constructions and is effective when insulating the ceiling to depths of about 8". It will be appreciated, however, that with some insulation materials, and particularly in the less temperate geographical areas, it may be desirable to insulate the ceilings to even greater depths, perhaps up to 15". In that case, a modified baffle board shown in FIGS. 8 and 9 and illustrated generally at 133 may be employed. The baffle board 133 is substantially identical to the baffle board 33 in all respects except that the distance from transverse fold line 137 to end 149 is substantially greater than the distance from transverse fold line 37 to end 49 for baffle board 33. The baffle board 133 accommodates use in truss and offset roofs and all of those standard roof constructions employing 2×4's or 2×6's as roof framing members.

FIG. 8 illustrates baffle board 133 folded and installed in a truss roof 514 using 2×4 framing members 515, 517. It is seen there that the baffle board 133 provides an effective barrier for a substantially increased depth of insulation illustrated by dot-dash line 550.

It will be apparent to those skilled in the art that various modifications, variations, additions and omissions can be made in the baffle board in the present invention without departing from the scope or spirit of the invention. For example, the baffle boards 33 and 133 can be constructed so that the spacing between longitudinal fold lines 51, 55 is substantially equal to the spacing between roof framing members such as those which are approximately 24" on center. The spacing between those framing members is about 23½" so that fold lines 51, 55 would also be spaced apart about 23½". Thus, it is intended that the present invention cover the modifications, variations, additions and omissions of this invention, provided they come within the scope of the appended claims and their equivalents.

What is claimed is:

1. An insulation baffle board constructed for use in buildings of the type having upstanding walls provided with a horizontal top plate, and a roof provided with framing members which include horizontal ceiling joists and rafters inclined upwardly from said ceiling joists, ceiling means fixed to said ceiling joists and roof sheathing means affixed atop said roof rafters, said ceiling means and roof sheathing means defining an attic space, said ceiling joists and said roof rafters coming together and secured in the area of said top plate, and said roof rafters extending outwardly beyond said top plate forming eaves, said attic space and eaves being communicated by openings defined between adjacent pairs of roof framinig members, said baffle board comprising a generally rectangularly shaped piece of stiff material, said baffle board having a pair of longitudinal fold lines along one side and a pair of longitudinal fold lines along the other side thereof, said longitudinal fold lines extending the full length of said baffle board, at least one transverse fold line extending between the innermost ones of said longitudinal fold lines, and slits extending from the ends of said at least one transverse fold line to opposite side edges of said baffle board said baffle boards being foldable along said at least one transverse fold line and positionable in the openings communicating the attic space and eaves so that a first section from one end to said at least one transverse fold line extends generally vertically of said top plate, and a second section from said at least one transverse fold line to the other end extends generally along and spaced from said roof sheathing, said baffle board being foldable along the longitudinal fold lines at each side edge to form tab means which lie against the roof framing members and can be secured thereto, said longitudinal fold lines facilitating selective folding of the baffle board to selectively form first and second sections of different widths.

2. An insulation baffle board as defined in claim 1, said first and second transverse fold lines being spaced from one end of said board about 3" to about 4", and about 5" to about 6", respectively.

3. An insulation baffle board as defined in claim 1, said baffle board including first and second transverse fold lines extending between the innermost ones of said longitudinal fold lines, and slits extending from the ends of each of said transverse fold lines to opposite side edges of said baffle board.

4. An insulation baffle board as defined in claim 1, the outermost ones of said longitudinal fold lines being spaced apart a distance substantially equal to a standard distance between roof framing members, the innermost one of said longitudinal fold lines being spaced from adjacent ones of the outermost fold lines a distance substantially equal to a standard thickness of roof framing member.

5. An insulation baffle board as defined in claim 1, said first section extending generally vertically from said wall top plate at or near its outer edge, whereby to permit the blown in insulation to extend to as close to the outer edge of said top plate as possible.

6. An insulation baffle board as defined in claim 2, said first and second transverse fold lines being spaced from the other end of said board about 9" to about 10", and about 7" to about 8", respectively.

7. An insulation baffle board as defined in claim 1, said board first section extending to a position spaced from said roof sheathing, said second section extending generally parallel to said roof sheathing and spaced therefrom.

8. An insulation baffle board as defined in claim 1, the pairs of roof framing members being coplanar and defining a truss roof, said board being folded along the outermost pair of said longitudinal fold lines.

9. An insulation baffle board as deinged in claim 1, the pairs of roof framing members being attached side-by-side and defining an offset roof, said board being folded along the outermost pair of said longitudinal fold lines throughout its second section, said board being folded along the outermost longitudinal fold line at one side and along the innermost fold line at its other side throughout its first section.

10. An insulation baffle board comprising a generally rectangular sheet of stiff material, first and second longitudinal fold lines extending the full length of the board along both sides thereof, said first longitudinal fold lines being spaced apart a distance substantially equal to a standard distance between adjacent ceiling joists and between adjacent roof rafters, said second longitudinal fold lines being spaced inwardly of adjacent ones of the first longitudinal fold lines a distance substantially equal to the standard thickness of roof framing members, at least one transverse fold line extending across said board between said second longitudinal fold lines, and slits extending from opposite ends of said at least one transverse fold line to the side edges of said board, whereby said board can be selectively folded along said longitudinal fold lines to form first and second sections of different widths.

11. An insulation baffle board as defined in claim 10, said first and second transverse fold lines being spaced from said one end of said board a distance substantially equal to the standard widths of first and second roof framing members, respectively.

12. An insulation baffle board as defined in claim 10, said board having first and second transverse fold lines extending between said second longitudinal fold lines, and slits extending from opposite ends of said transverse fold lines to the side edges of said board.

* * * * *